US006386241B1

(12) United States Patent
Griffith

(10) Patent No.: US 6,386,241 B1
(45) Date of Patent: May 14, 2002

(54) LENO WEAVING

(75) Inventor: John Dalton Griffith, Sunderland (GB)

(73) Assignee: Griffith Textile Machines Ltd., Tyne & Wear (GB)

( * ) Notice: Subject to any disclaimer, the term of this patent is extended or adjusted under 35 U.S.C. 154(b) by 0 days.

(21) Appl. No.: 09/743,398

(22) PCT Filed: Jul. 9, 1999

(86) PCT No.: PCT/GB99/02207

§ 371 Date: Jan. 8, 2001

§ 102(e) Date: Jan. 8, 2001

(87) PCT Pub. No.: WO00/03077

PCT Pub. Date: Jan. 20, 2000

(30) Foreign Application Priority Data

Jul. 11, 1998 (GB) ..... 9814971

(51) Int. Cl.[7] ..... D03C 7/00; D03D 49/62
(52) U.S. Cl. ..... 139/192
(58) Field of Search ..... 139/192

(56) References Cited

U.S. PATENT DOCUMENTS 4,721,135 A * 1/1988 Tsubata et al. ..... 139/46
5,085,253 A * 2/1992 Motta ..... 139/50
5,419,375 A * 5/1995 Corain et al. ..... 139/54

* cited by examiner

*Primary Examiner*—Andy Falik
(74) *Attorney, Agent, or Firm*—Nikolai & Mersereau, P.A.

(57) ABSTRACT

A reed assembly for leno weaving, the reed assembly including upper and lower reed frame members between which a plurality of dent fingers extend, each pair of neighbouring dent fingers being spaced apart to define a dent space for a crossing-over warp yarn, a yarn guide finger co-operating with each dent space for guiding a crossed-over warp yarn therethrough, each yarn guide finger extending from one of the frame members and having a terminal end spaced from the other frame member so as to divide the co-operating dent space into a pair of cross-over dent spaces extending between said terminal end and said one frame member and being defined between facing sides of the guide finger and the pair of neighbouring dent fingers and cross-over transfer region extending between said terminal end and said other frame member and being located between opposed faces of the pair of neighbouring dent fingers.

16 Claims, 9 Drawing Sheets

LENO WEAVING

The present invention relates to leno weaving, in particular a reed assembly for leno weaving and a loom for leno weaving.

The invention also relates to a method of leno weaving.

According to one aspect of the present invention there is provided a reed assembly for leno weaving, the reed assembly including upper and lower reed frame members between which a plurality of dent fingers extend, each pair of neighbouring dent fingers being spaced apart to define a dent space for a crossing-over warp yarn, a yarn guide finger co-operating with each dent space for guiding a crossed-over warp yarn therethrough, each yarn guide finger extending from one of the frame members and having a terminal end spaced from the other frame member so as to divide the cooperating dent space into a pair of cross-over dent spaces extending between said terminal end and said one frame member and being defined between facing sides of the guide finger and the pair of neighbouring dent fingers and a cross-over transfer region extending between said terminal end and said other frame member and being located between opposed faces of the pair of neighbouring dent fingers.

According to another aspect of the present invention there is provided a leno loom including a reed assembly defined above.

According to another aspect of the invention there is provided a method of leno weaving comprising threading a first set of crossed-over warp yarns through a guide eye in each of the yarn guide fingers, threading a second set of crossing-over warp yarns through each dent space, oscillating the reed assembly between weft insertion and beat-up positions, guiding the second set of yarns such that at said beat-up position of the reed assembly, the crossing-over yarns are located in said cross-over transfer region and operating the reed assembly when said second yarns are in said transfer region to relatively position said yarns for entry into alternate ones of said pair of cross-over dent spaces on successive weaving cycles.

According to another aspect of the present invention there is provided a method of converting a heard operated loom to a leno weaving loom including the step of substituting the conventional reed assembly by a reed assembly as defined above.

Various aspects of the present invention are hereinafter described with reference to the accompanying drawings, in which.

Figure 1:
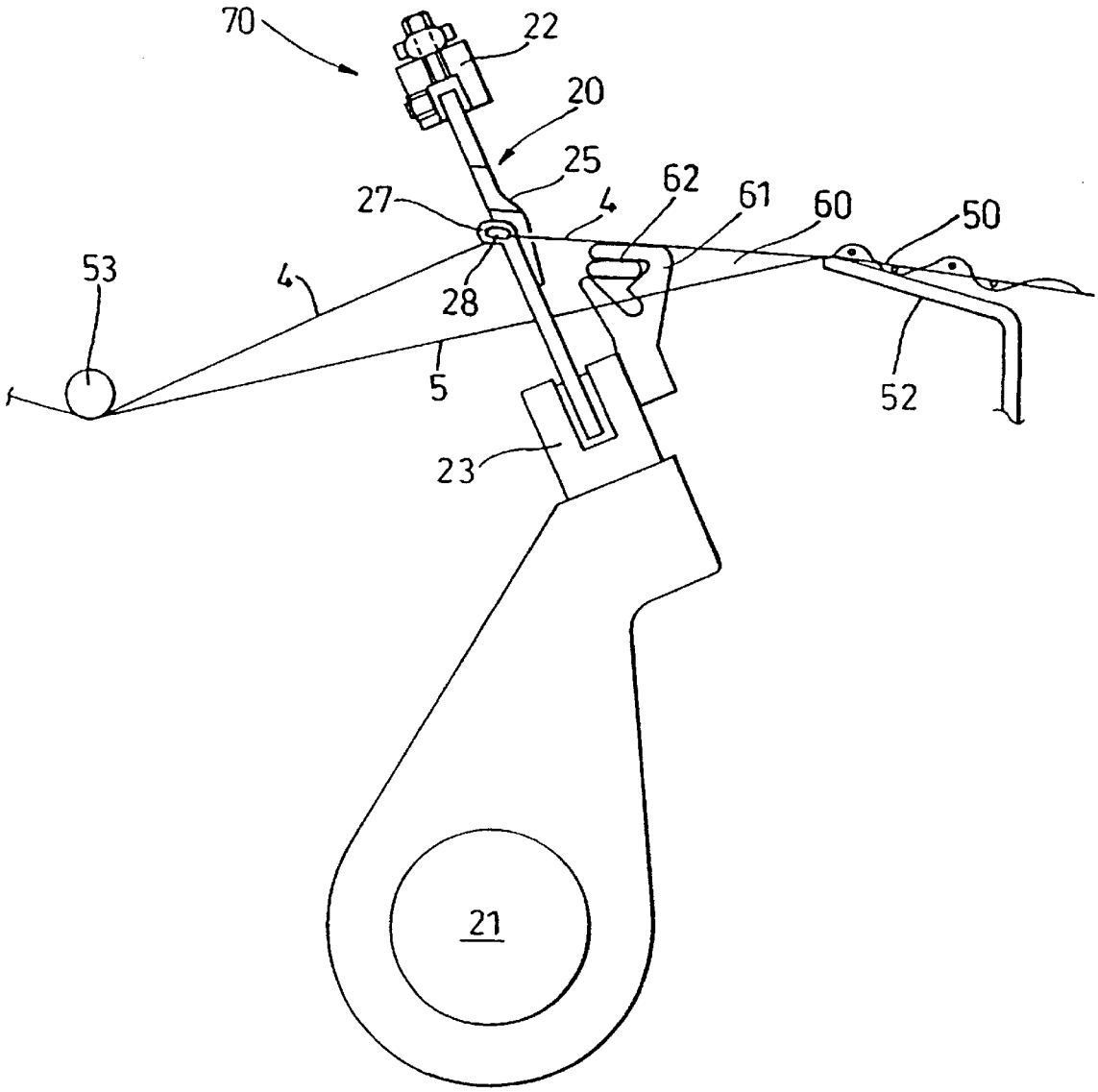
FIGS. 1, 2 and 3 are schematic end views of a first embodiment according to the present invention shown in different operating positions.
Figure 2:
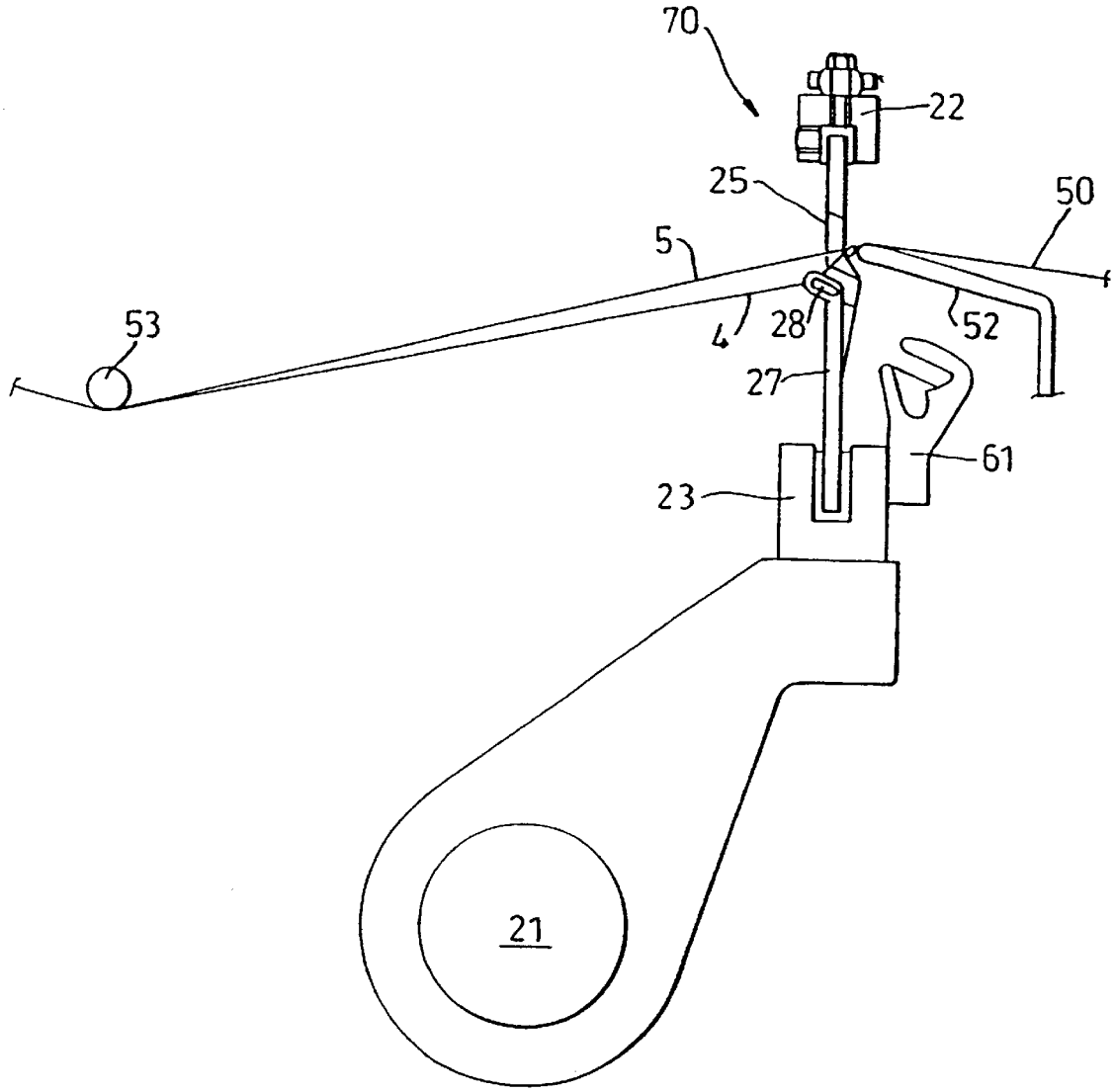

Referring initially to FIGS. 1 to 4 there is shown a reed 20 mounted on a reed drive shaft 21 which reciprocates to move the reed between a weft yarn insertion position (as shown in FIG. 1) and a beat-up position (as shown in FIG. 2).

The reed 20 includes an upper elongate frame member 22 and a lower elongate frame member 23. A plurality of dent fingers 25 are provided which are secured at opposite ends to the upper and lower frame members 22, 23 respectively.

The dent fingers 25 are spaced apart along the length of the reed 20 to define a dent space 26 between each pair of adjacent dent fingers 25.

A crossing-over warp yarn 5 is located within each dent space 26.

Extending upwardly from the lower frame member 23 into each dent space 26 is a yarn guide or needle finger 27 having at its terminal end an eye 28 through which a crossed-over warp yarn 4 is guided.

The needle finger 27 divides the dent space 26 into two cross-over dent spaces 26*a*, 26*b* located on opposite sides of the fingers 27 and a cross-over transfer zone 26*c*.

The dent fingers 25 are flexible in the longitudinal direction of the reed and the upper frame member 22 is arranged to be reciprocated relative to the lower frame member 23 in the longitudinal direction of the reed 20 by drive means 70. Such reciprocal movement of the upper frame member 22 causes the dent fingers 25 to be flexed between two longitudinal, cross-over positions, a first of these positions is illustrated in FIG. 5 and a second of these positions is illustrated in FIG. 6.

Figure 4:
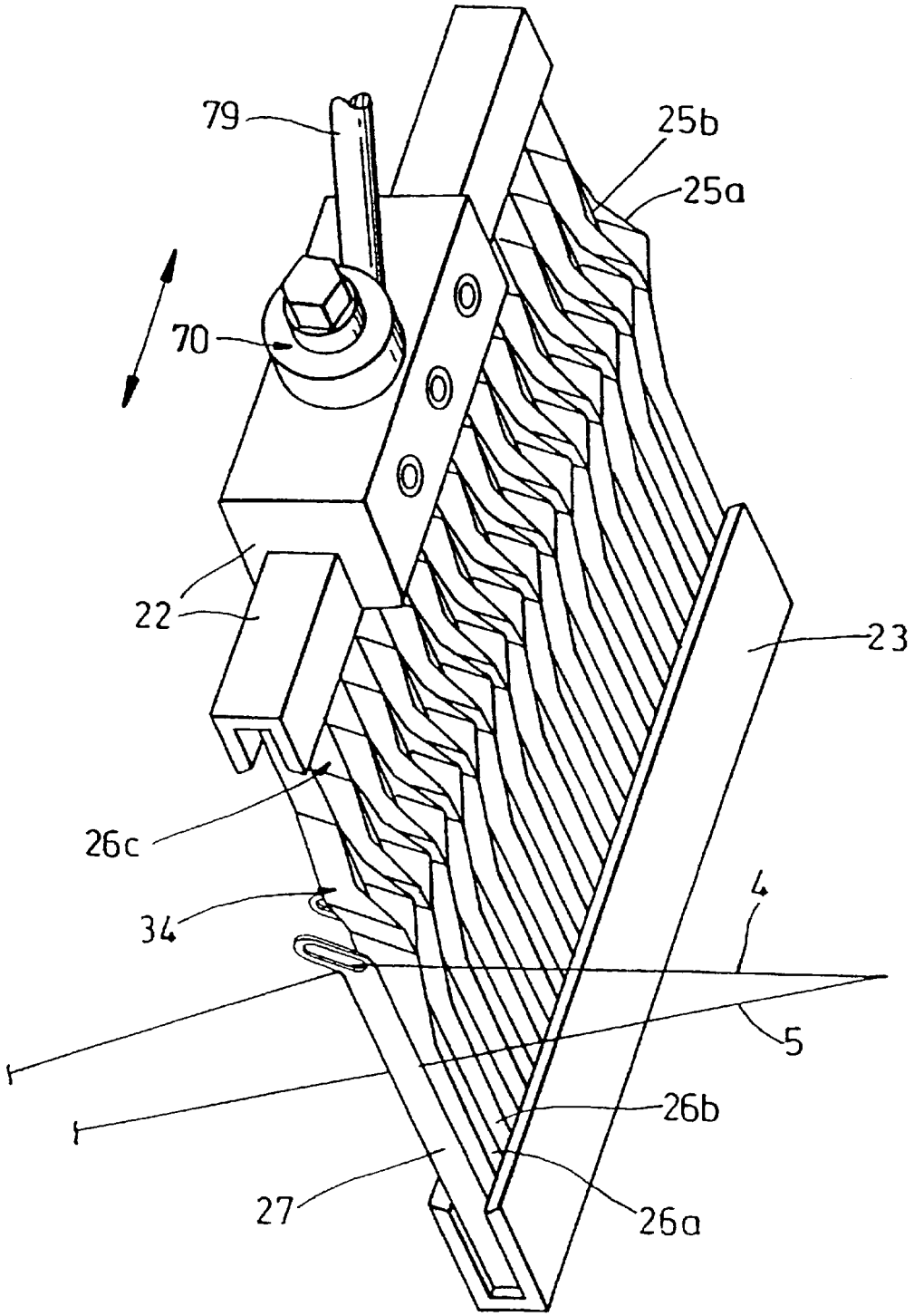
FIG. 4 is a part perspective view of the reed shown in FIG. 1.
Figure 5:
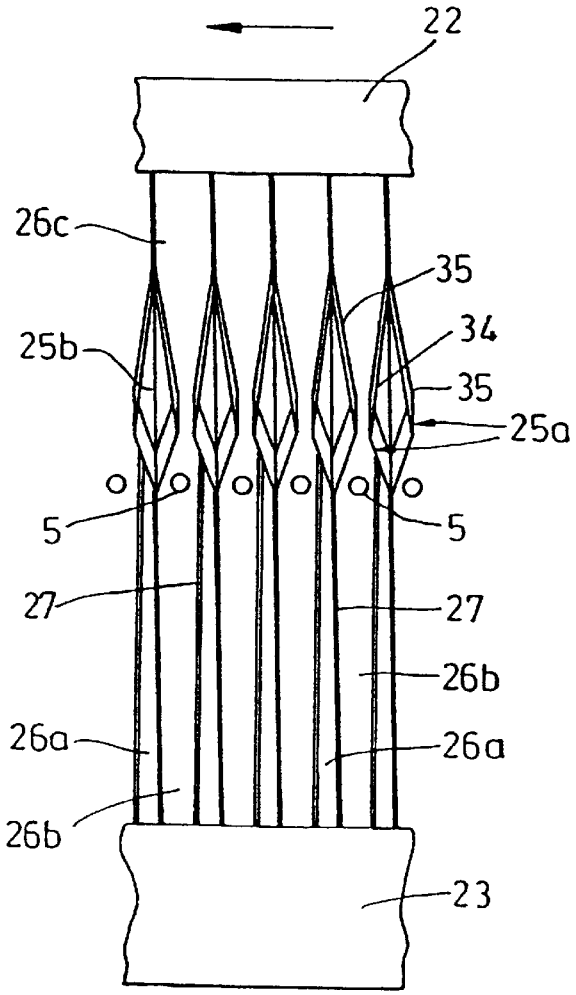
FIGS. 5 and 6 are front views of the reed illustrated in FIG. 4 shown in different operating positions.
Figure 6:
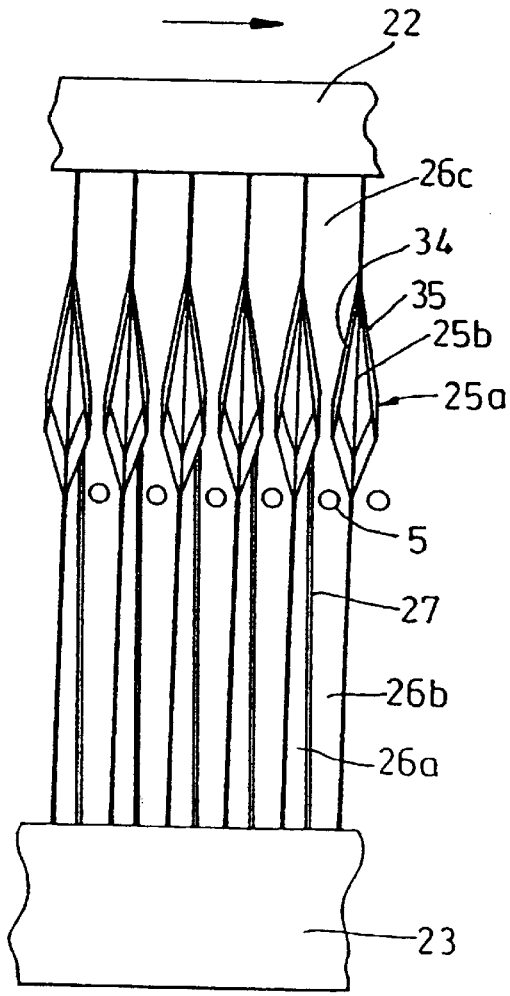
Figure 7:
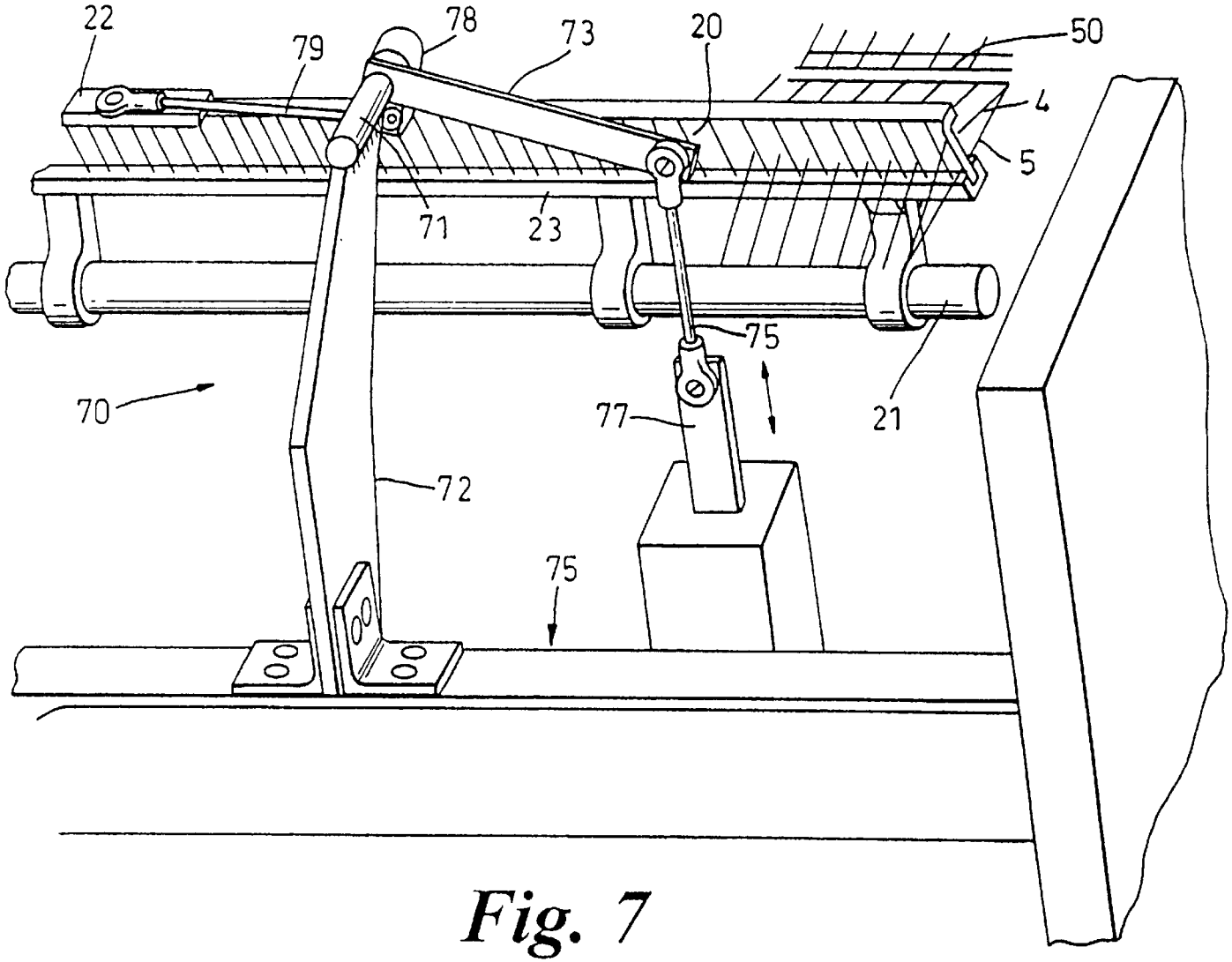
FIG. 7 is a part perspective view showing a drive mechanism for operating the reed shown in FIG. 1.

As more clearly seen in FIGS. 4, 5 and 6, the dent fingers 25 are provided with a yarn guide face 34 on one side and a yarn guide face 35 on its opposite side. The guide faces 34, 35 are located above the terminal end of the needle finger location within the dent space 26 defined therebetween so as to enable the guide faces 34,35 to alternately co-operate with the terminal end of the needle finger 27 for alternatively opening and closing access to dent spaces 26*a*, 26*b*. A crossing-over warp yarn 5 passes through each dent space 26 and depending upon the longitudinal position of the upper frame element 22 is alternately guided into dent spaces 26*a* and 26*b* on successive weaving cycles.

In operation, the reed 20 is oscillated between its weft insertion position (FIG. 1) and its beat-up position (FIG. 2) to produce leno fabric 50 which is guided by a support plate 52. The threads 4 and 5 are guided from a supply of yarn (not shown) via a guide roller 53 toward the support plate 52. The relative positions of the guide roller 53 support plate 52 and the reed 20 are arranged such that when the reed 20 is located at its weft insertion position the terminal end of the fingers 27 is located above the path of travel of yarns 5 such that the sheet of warp yarns 4 define an upper shed and the sheet of warp yarns 5 define a lower shed of a shed opening 60. This is shown in FIG. 1.

Preferably in this position, projectile guide fingers 61 are located within opening 60 for guiding a weft insertion projectile 60.

Furthermore the relative positions are such that at the beat-up position of the reed 20, the terminal ends of the fingers 27 are located below the path of travel of yarns 5. This is shown in FIG. 2.

In this position of the reed, the yarn 5 in each dent space 26 is located above the terminal end of the fingers 27 in region 26*c*. Accordingly whilst the reed 20 is in this position, the upper frame member 22 is moved to its opposite longitudinal position by drive means 70 so as to deflect the dent fingers 25 and cause the terminal end of needle finger 27 to contact the opposite dent finger 25. Accordingly the dent space 26*a* or 26*b* which was closed on the previous weaving cycle is now open.

Figure 3:
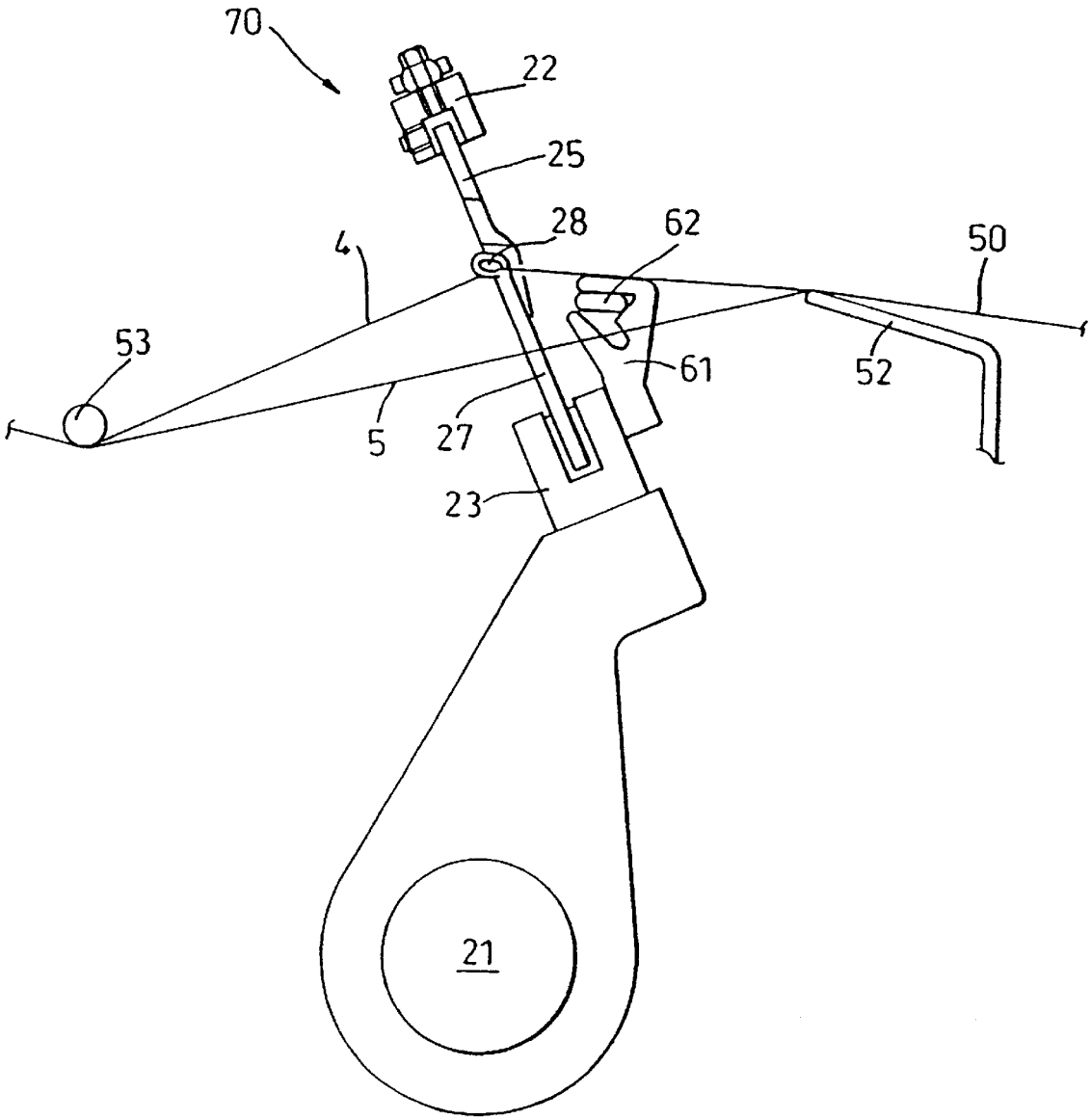

As the reed 20 is moved to its weft insertion position, the yarn 5 in each dent space 26 is now moved into the open dent space 26*a* or 26*b*. This is illustrated in FIGS. 1, 2 and 3 wherein in FIG. 1 yarn 5 is shown as passing behind dent needle 27, ie. it is located in dent space 26*b* whereas after the reed 20 has moved to its beat-up position (FIG. 2) and then returned to its weft insertion position (FIG. 3), yarn 5 is now located in front of needle finger 27, ie. it is located in dent space 26*a*.

Preferably as shown in FIGS. 5 and 6, in order to define guide faces 34 and 35, each dent finger 25 preferably comprises two strips of material, such as spring steel, which are superimposed and provided with bent portions 25*a* which constitute the guide faces 34, 35.

An optional reinforcing strip 25*b* may be located in between the opposed bent portions 25*a*.

Figure 8:
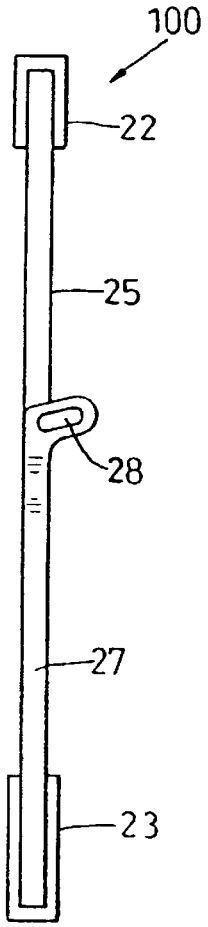
FIG. 8 is an end view of a reed according to a second embodiment of the present invention.
Figure 9:
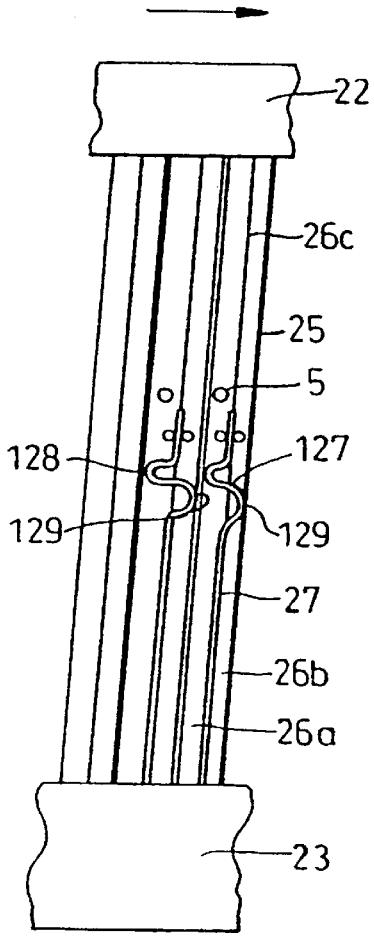
FIGS. 9 and 10 are part front views of the reed illustrated in FIG. 8 shown in different operating positions.
Figure 10:
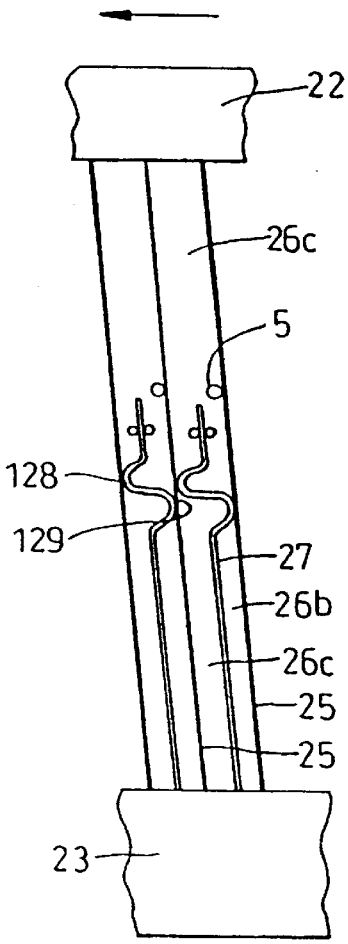

An alternative embodiment 100 is illustrated in FIGS. 8 to 10. Embodiment 100 differs from the embodiment of FIGS. 5 and 6 in that the needle fingers 27 are moved between alternative side positions relative to the yarn 5 to effect cross-over. Accordingly, in embodiment 100, dent fingers 25 are not provided with yarn guide faces 34, 35. Instead fingers 25 are planar and each needle finger 27 is adapted to contact opposed fingers 25 which define the dent space 26 in which the needle finger 27 is located.

In this respect, each needle finger 27 is preferably provided with an abutment head 127 having side faces 128, 129 which contact opposed fingers 25 and so maintain the needle finger 27 central within space 26 and also cause the finger 27 to deflect sideways when fingers 25 are deflected.

Accordingly, when the upper frame member 23 is moved from one of its longitudinal positions to its other longitudinal position for cross-over of yarn 5, the position of the needle finger 27 relative to the cross-over yarn 5 is changed. In this respect, in one longitudinal position of frame member 23 each yarn 5 is located directly above dent space 26*a* (FIG. 9) and in the other longitudinal position of frame member 23 each yarn 5 is located directly above dent space 26*b* (FIG. 10).

When the reed 20 is advanced to its weft insertion position, yarn 5 moves toward the dent space 26*a*, or 26*b* which is directly beneath it and the dent fingers 25 and/or abutment head 127 are formed so as to deflect in order to enable the yarn 5 to enter the relevant dent space.

Preferably as shown, the abutment head 127 is formed by bending the finger 27 and is preferably located beneath the yarn guide eye 28.

A further alternative embodiment 200 is illustrated in FIGS. 11 to 15.

In embodiment 200, parts similar to those in the previous embodiments have been designated with the same reference numerals.

In embodiment 200, the needle fingers 27 are located in between adjacent dent fingers 25 but project rearwardly such that the upper terminal end of each finger 27 is located to the exterior of the dent space 26 defined directly in between opposed faces 25*a*, 25*b* of adjacent dent fingers 25.

Although the upper part of each needle finger 27 is not located directly inbetween the pair of adjacent dent fingers 25 with which it co-operates, the needle finger 27 still serves the purpose of dividing the co-operating dent space 26 into a pair of cross-over dent spaces 26*a*, 26*b* and the cross-over region 26*c*.

Figure 11:
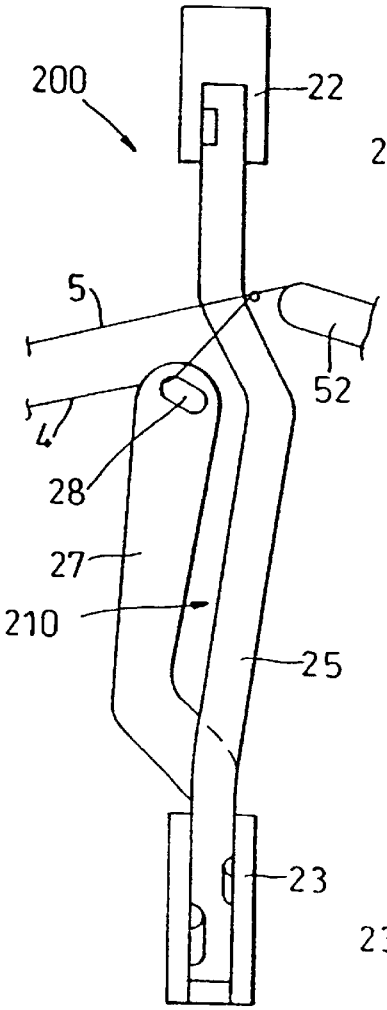
FIG. 11 is an end view of a reed according to a third embodiment of the present invention.
Figure 12:
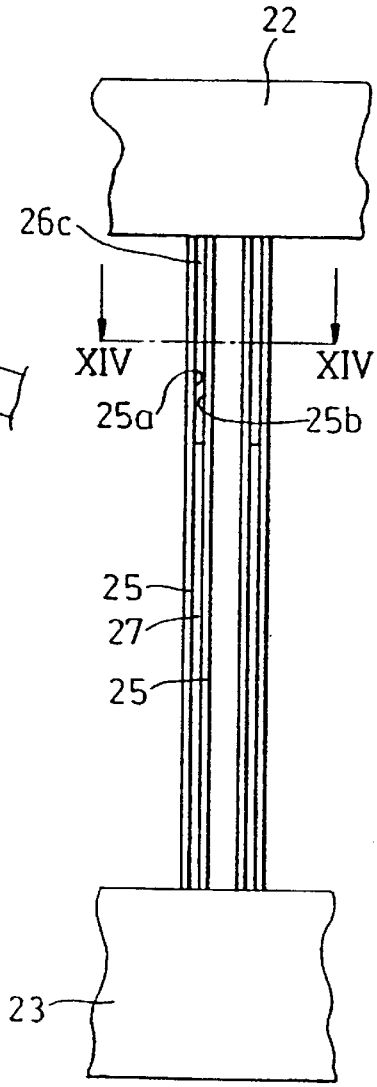
FIGS. 12 and 13 are part front views of the reed illustrated in FIG. 11 shown in different operating positions.

As seen in FIG. 11, preferably both the dent fingers 25 and needle fingers 27 are oppositely cranked in order to position the terminal end of each needle finger 27 outside the dent space 26.

Preferably as seen in FIG. 11, the needle finger 27 and dent finger 25 are arranged so as to be spaced apart in the the warp feed direction so as to define an elongate gap 210. The length of the gap 210 is chosen so as to extend beyond the maximum displacement of the crossing-over yarn 5 toward the bottom of the dent space 26 (ie. towards lower frame member 23) when the teed is at its weft insertion position. In this way the crossing-over yarn 5 is able to pass unhindered around the guide finger 27 and through the dent spaces 26 without danger of being trapped.

However it will be appreciated that other arrangements may be adopted to obtain the desired positions of the terminal ends of the needle fingers 27 relative to the dent fingers 25, for example dent fingers 25 may be cranked as shown and needle fingers 27 may be relatively straight or vice versa.

Figure 13:
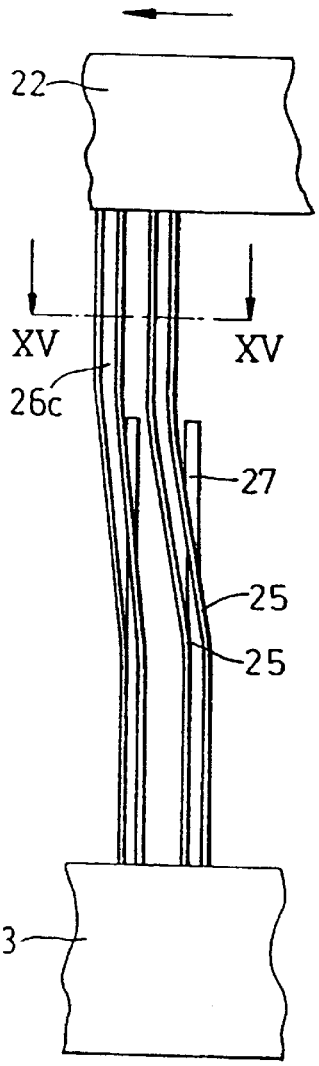
Figure 14:
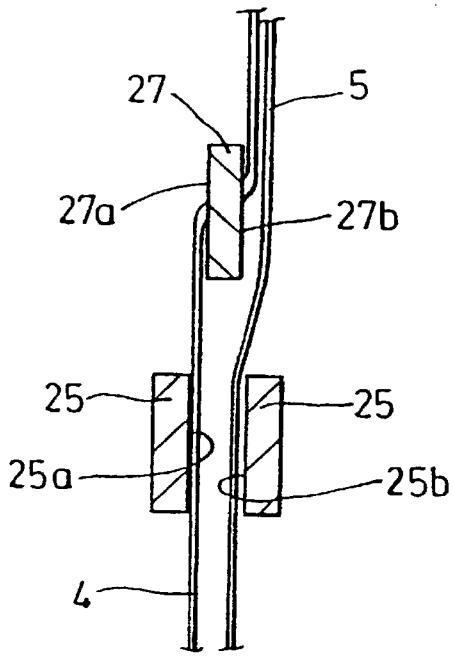
FIG. 14 is a part sectional view taken along line XIV—XIV in FIG. 12.
Figure 15:
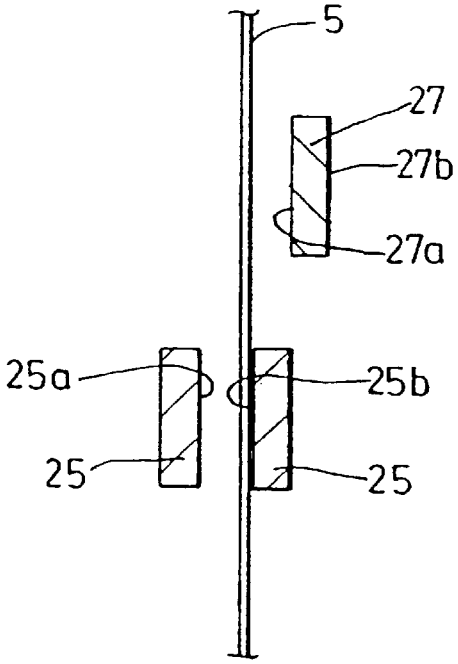
FIG. 15 is a part sectional view taken along line XV—XV in FIG. 13.

By virtue of the terminal ends of the needle fingers 27 being located outside the dent space 26 (as formed between the directly opposed faces 25*a*, 25*b*) the needle fingers 27 are not engaged by the dent fingers 25 on longitudinal movement of the upper frame member 22. Accordingly as illustrated in FIG. 13, when the dent fingers 25 are displaced to the left side cross-over position, each dent finger 25 moves relative to its co-operating needle finger 27 to reside at a cross-over position whereat the cross-over thread 5 is free to pass between the opposed right hand face 25*b* of dent finger 25 and left hand face 27*a* of needle finger 27 (which faces collectively define cross-over dent space 26*a*). On the next successive weaving cycle, the dent fingers 25 are displaced to their right side cross-over position to enable the cross-over thread 5 to pass between the opposed left hand face 25*a* of dent finger 25 and right hand face 27*b* of needle finger 27 (which opposed faces collectively define cross-over dent space 26*b*).

It will be appreciated that in embodiment 200 both the dent fingers 25 and needle fingers 27 may be planar, as shown, and preferably formed from a suitable sheet material. Such a construction is relatively simple from a manufacturing point of view. In addition, it enables a relatively high warp density to be achieved, if desired.

It will be appreciated that the amount of displacement of the dent fingers to their left side or right side cross-over positions need only be of a minimum value in order to move the right dent face 25*b* or left dent face 25*a* relatively beyond left needle face 27*a* or right needle face 27*b* respectively in order to open the respective cross-over dent space. Accordingly, by setting the displacement to be slightly greater than this minimum displacement it is possible to ensure reliable cross-over operation in a convenient manner.

Drive means 70 are provided for reciprocating the upper reed frame member 22 between its longitudinal cross-over positions.

Preferably the drive means 70 for all embodiments of reed described above include a drive shaft 71 rotatably mounted on a support bracket 72. The support bracket 72 is secured to the main frame 75 of the loom.

The drive shaft 71 is provided with a lever 73 which is fixedly secured at one end to the shaft 71 and is pivotally attached at its opposite end to a push rod 75. The push rod 75 is pivotally attached at its opposite end to an oscillating drive rod 77. The oscillating drive rod 77 is normally provided on a heald operated loom for raising/lowering of the healds.

The drive shaft 71 is provided with a second lever 78 which drives a push rod 79 that is pivotally attached at one end to lever 78 and pivotally attached at its opposite end to frame member 23. Accordingly reciprocation of the drive rod 77 causes reciprocation of the frame member 23.

It will be appreciated therefore that the present invention enables a heald operating loom to be easily converted for leno weaving by substituting the reed 20 of the present invention for the conventional reed on the loom, removing the heald frames and installing the drive means 70.

What is claimed is:

1. A reed assembly for leno weaving, the reed assembly including upper and lower reed frame members between which a plurality of dent fingers extend, each pair of neighbouring dent fingers being spaced apart to define a dent space for a crossing-over warp yarn, a yarn guide finger co-operating with each dent space for guiding a crossed-over warp yarn therethrough, each yarn guide finger extending from one of the frame members and having a terminal end spaced from the other frame member so as to divide the co-operating dent space into a pair of cross-over dent spaces extending between said terminal end and said one frame member and being defined between facing sides of the guide finger and the pair of neighbouring dent fingers and a cross-over transfer region extending between said terminal end and said other frame member and being located between opposed faces of the pair of neighbouring dent fingers, the dent fingers are flexible to enable said frame members to be displaced longitudinally relative to one another to control access of the crossing-over warp yarn from the cross-over transfer region and into one or other of said pair of cross-over dent spaces.

2. A reed assembly according to claim 1 wherein said one reed frame member is arranged to be longitudinally fixed and said other reed frame member is arranged to be oscillated longitudinally between first and second longitudinal positions.

3. A reed assembly according to claim 2 wherein each of said yarn guide fingers is planar and is located directly in between a pair of neighbouring dent fingers, said dent fingers including yarn guide means for directing the crossing-over warp yarn into said one or other cross-over dent spaces.

4. A reed assembly according to claim 3 for insertion on a loom.

5. A reed assembly according to claim 2 wherein each of said yarn guide fingers is located in between and extends to the rear of each pair of neighbouring dent fingers.

6. A reed assembly according to claim 2 for insertion on a loom.

7. A reed assembly according to claim 5 wherein each of said dent fingers and yarn guide fingers are planar.

8. A reed assembly according to claim 5 for insertion on a loom.

9. A reed assembly according to claim 7 for insertion on a loom.

10. A reed assembly according to claim 2 wherein each of said pairs of neighbouring dent fingers are adapted to co-operate with a yarn guide finger to deflect the yarn guide finger between first and second positions to permit the crossing-over yarn to access one or other of said cross-over dent spaces.

11. A reed assembly according to claim 10 for insertion on a loom.

12. A reed assembly according to claim 10 wherein each yarn guide finger has a head portion which abuts against each dent finger of said pair of neighbouring dent fingers, the head portion serving to maintain the yarn guide finger centrally located in between the pair of neighbouring dent fingers.

13. A reed assembly according to claim 12 for insertion on a loom.

14. A reed assembly according to claim 1 for insertion on a loom.

15. A method of leno weaving using a reed assembly having a lower frame member with a plurality of yarn guide fingers with each guide finger having a guide eye comprising threading a first set of crossed-over warp yarns through the guide eye in each of the yarn guide fingers, threading a second set of crossing-over warp yarns through each dent space, oscillating a reed assembly between weft insertion and beat-up positions, guiding the second set of yarns such that at said beat-up position of the reed assembly, the crossing-over yarns are located in a cross-over transfer region and operating the reed assembly when said second yarns are in said transfer region to relatively position said yarns for entry into alternate ones of a pair of cross-over dent spaces on successive weaving cycles.

16. A method of converting a heald operating loom for leno weaving, the heald operating loom including a beat-up reed, a plurality of heald frames and heald drive means for raising or lowering the heald frames, the method comprising the steps of replacing said beat-up reed with said reed assembly, removing said heald frames and connecting said heald drive means to said reed assembly for causing said frame members to be longitudinally displaced relative to one another.

* * * * *